US005762123A

United States Patent [19]

Kuyama et al.

[11] Patent Number: 5,762,123

[45] Date of Patent: Jun. 9, 1998

[54] DOOR SYSTEM

[75] Inventors: Kazuo Kuyama, Amagasaki; Kozo Nishihira, Kobe, both of Japan

[73] Assignee: Nabco Limited, Kobe, Japan

[21] Appl. No.: 783,739

[22] Filed: Jan. 16, 1997

Related U.S. Application Data

[63] Continuation-in-part of Ser. No. 703,579, Aug. 27, 1996, abandoned, which is a continuation of Ser. No. 430,557, Apr. 28, 1995, abandoned.

[30] Foreign Application Priority Data

Apr. 28, 1994 [JP] Japan ..... 6-114776

[51] Int. Cl.[6] ..... E05D 15/06

[52] U.S. Cl. ..... 160/195; 160/118; 160/213

[58] Field of Search ..... 160/195, 199, 160/206, 213, 118, 117, 210, 335; 49/141, 128, 127, 125, 104, 246, 247

[56] References Cited

U.S. PATENT DOCUMENTS

| | | | |
|---|---|---|---|
| 3,092,170 | 6/1963 | Ellis | 160/26 |
| 3,101,777 | 8/1963 | Sherron | 160/206 |
| 3,138,474 | 6/1964 | Reiss et al. | 160/206 |
| 3,342,246 | 9/1967 | Reiss | 160/195 |
| 3,675,370 | 7/1972 | Catlett | 49/253 |
| 4,534,395 | 8/1985 | Carroll | 160/199 |
| 5,242,005 | 9/1993 | Borgardt | 160/118 |
| 5,392,834 | 2/1995 | Borgardt . | |

FOREIGN PATENT DOCUMENTS

| | | |
|---|---|---|
| HEI 1-138083 | 9/1989 | Japan . |
| HEI 4-1257 | 1/1992 | Japan . |
| HEI 4-2296 | 1/1992 | Japan . |
| HEI 4-3106 | 1/1992 | Japan . |
| HEI 6-3971 | 2/1994 | Japan . |
| HEI 7-301049 | 11/1995 | Japan . |

*Primary Examiner*—Blair Johnson

*Attorney, Agent, or Firm*—Duane, Morris & Heckscher LLP

[57] ABSTRACT

A door is mounted within a doorway to be pivotal about a pivot axis disposed close to and along one of side surfaces of the doorway to selectively open and close the doorway. A guide roller protrudes toward the upper surface of the doorway from the upper edge of the door at a location remote from the location of the pivot axis when the door is closed. A guide rail extends along the length of the upper surface of the doorway for guiding the guide roller along the length of the upper surface of the doorway. The guide rail is pivotal about the pivot axis. Means is provided to disengageably engage the guide rail with the upper surface of the doorway.

9 Claims, 9 Drawing Sheets

DOOR SYSTEM

This is a continuation-in-part application of patent application Ser. No. 08/703,579 filed on Aug. 27, 1996, now abandoned, which is a continuaion application of patent application Ser. No. 08/430,557 filed on Apr. 28, 1995, now abandoned.

This invention relates to a door system with emergency escape enabling provision and, more particularly, to a power actuated door system, such as a power actuated folding door system and a power actuated balanced door system, with an emergency escape enabling mechanism.

BACKGROUND OF THE INVENTION

Many buildings are provided with door systems with automatic door actuating drive arrangements. When an emergency condition, such as electric power failure, occurs when the doors are closed, people within the building cannot get out because no power is available for opening the doors. It is, therefore, desirable to provide such door systems with emergency escape enabling means so that the doors can be opened by human power.

Examples of such door systems with emergency escape enabling means are disclosed in, for example, U.S. Pat. Nos. 4,534,395 (W. F. Carroll) and 3,675,370 (J. C. Catlett). The door system disclosed in the Carroll is a folding door with an emergency escape enabling mechanism, and the door system disclosed in the Catlett is a balanced door with an emergency escape enabling mechanism.

The emergency escape enabling mechanisms of these door systems of the U.S. patents are so arranged that, under an emergency condition, when a door is pushed outward from the inside the building, the door can be removed from the doorway.

When the normal condition is restored after people get out of the building through the door opened by the aid of this emergency escape enabling mechanism, the removed door must be returned to its original position. However, in the prior art door systems, because of their structures, it is troublesome and difficult for a man to attach the removed door to the door structure, unless he knows well the structure of the door system and experienced in handling it.

An object of the present invention is to provide a door system with emergency escape enabling provision, in which a door removed out of the doorway under an emergency condition can be readily returned to its original position in the door structure after the emergency condition is removed.

SUMMARY OF THE INVENTION

A door system according to an embodiment of the present invention includes a door which selectively closes and opens a doorway which is defined by two parallel vertical surfaces of jamb means and a lower horizontal surface of lintel means, which lower surface of the lintel means extends generally perpendicular to the parallel vertical surfaces in an upper portion of the doorway. The door includes a pivot axis disposed near and along one of the vertical surfaces and a panel mounted to be pivotal about the pivot axis. Means to be guided (hereinafter referred to as guided means) is disposed which extends from the upper edge of the panel at a location remote from the pivot axis toward the lintel means when the door is closed. Guide means is disposed along the lower horizontal surface of the lintel means for guiding the guided means along the lower surface of the lintel means. The guide means is also arranged to be pivotal about the pivot axis.

The door system further includes an engagement arrangement for removably engaging the guide means with the lintel means.

The engagement arrangement includes a first wall. The first wall is formed on the lintel means on its innser side and extends horizontally along the length of the lintel means and vertically to a position which is downward of the lower horizontal surface of the lintel means and is spaced from the upper surface of the guide means. Support means extends from a lower portion of the first wall toward the outer side of the door. The support means has a cross-section perpendicular to the lower surface of the lintel means which is uniform in shape along the length of the support means. A second wall is formed on the guide means on its outer side and extends horizontally along the length of the guide means and vertically upward from the upper surface of the guide means. Engagement means extends from an upper portion of the second wall toward the inner side of the door. The engagement means has a cross-section perpendicular to the guide means which is uniform in shape along the length of the guide means. The engagement means is adapted to ride on the upper surface of the support means to engage therewith and normally rest on it. The guide means has a third wall which extends upward from the upper surface on the inner side of the guide means.

Stopper means is disposed between the lower surface of the support means and the upper surface of the guide means. The stopper means restricts the sway of the guide means.

A plurality of such stopper means may be disposed, being spaced from each other along the length of the guide means.

The support means may have an upward facing concave first surface on which the engagement means can ride and rest, whereas the engagement means may have a downward facing convex second surface which can ride and rest on the first surface.

The stopper means includes a land which can contact a portion of the lower surface of the support means on its outer side, and a projection which can contact the lower edge of the support means and the upper edge of the third wall.

First stopper means may be disposed at a location remoter from the pivot axis with second stopper means disposed at a location nearer to the pivot axis. The first stopper means includes a first land contacting a portion of the lower surface of the support means on its outer side, and a first projection contacting the lower edge of the first wall and the upper edge of the third wall. The second stopper means includes a second land spaced from a portion of the lower surface of the support means on its outer side, and a second projection spaced from the lower edge of the first wall and the upper edge of the third wall.

A door system according to a second embodiment of the present invention includes a door which selectively closes and opens a doorway which is defined by two parallel vertical surfaces of jamb means and a lower horizontal surface of lintel means, which lower surface of the lintel means extends generally perpendicular to the parallel vertical surfaces in an upper portion of the doorway. The door includes a pivot axis disposed near and along one of the vertical surfaces and a panel coupled to an arm extending from the pivot axis. Means to be guided (hereinafter referred to as guided means) is disposed which extends from the upper edge of the panel at a location remote from the pivot axis toward the lintel means when the door is closed. Guide means is disposed along the lower horizontal surface of the lintel means for guiding the guided means along the lower surface of the lintel means. The guide means is also arranged to be pivotal about the pivot axis. The door system further includes an engagement arrangement for removably engaging the guide means with the lintel means.

The engagement arrangement includes a first wall. The first wall is formed on the lintel means on its inner side and extends horizontally along the length of the lintel means and vertically to a position which is downward of the lower horizontal surface of the lintel means and is spaced from the upper surface of the guide means. Support means extends from a lower portion of the first wall toward the outer side of the door. The support means has a cross-section perpendicular to the lower surface of the lintel means which is uniform in shape along the length of the support means. A second wall is formed on the guide means on its outer side. The second wall extends horizontally along the length of the guide means, and extends vertically upward of the upper surface of the guide means. Engagement means extends from an upper portion of the second wall toward the inner side of the door. The engagement means has a cross-section perpendicular to the guide means which is uniform in shape along the length of the guide means. The engagement means is adapted to ride on the upper surface of the support means to engage therewith and normally rest on it. The guide means has a third wall which extends upward from the upper surface on the inner side of the guide means.

Stopper means is disposed between the lower surface of the support means and the upper surface of the guide means. The stopper means restricts the sway of the guide means.

The panel may be coupled to the arm at a location substantially midway between the pivot axis and the guided means.

A plurality of such stopper means may be disposed, being spaced from each other along the length of the guide means.

The support means may have an upward facing concave first surface on which the engagement means can ride and rest, whereas the engagement means may have a downward facing convex second surface which can ride and rest on the first surface.

The stopper means includes a land which can contact a portion of the lower surface of the support means on its outer side, and a projection which can contact the lower edge of the support means and the upper edge of the third wall.

First stopper means may be disposed at a location remote from the pivot axis with second stopper means disposed at a location near the pivot axis. The first stopper means includes a first land contacting a portion of the lower surface of the support means on its outer side, and a first projection contacting the lower edge of the first wall and the upper edge of the third wall. The second stopper means includes a second land spaced from a portion of the lower surface of the support means on its outer side, and a second projection spaced from the lower edge of the first wall and the upper edge of the third wall.

DETAILED DESCRIPTION OF PREFERRED EMBODIMENTS

Figure 1:
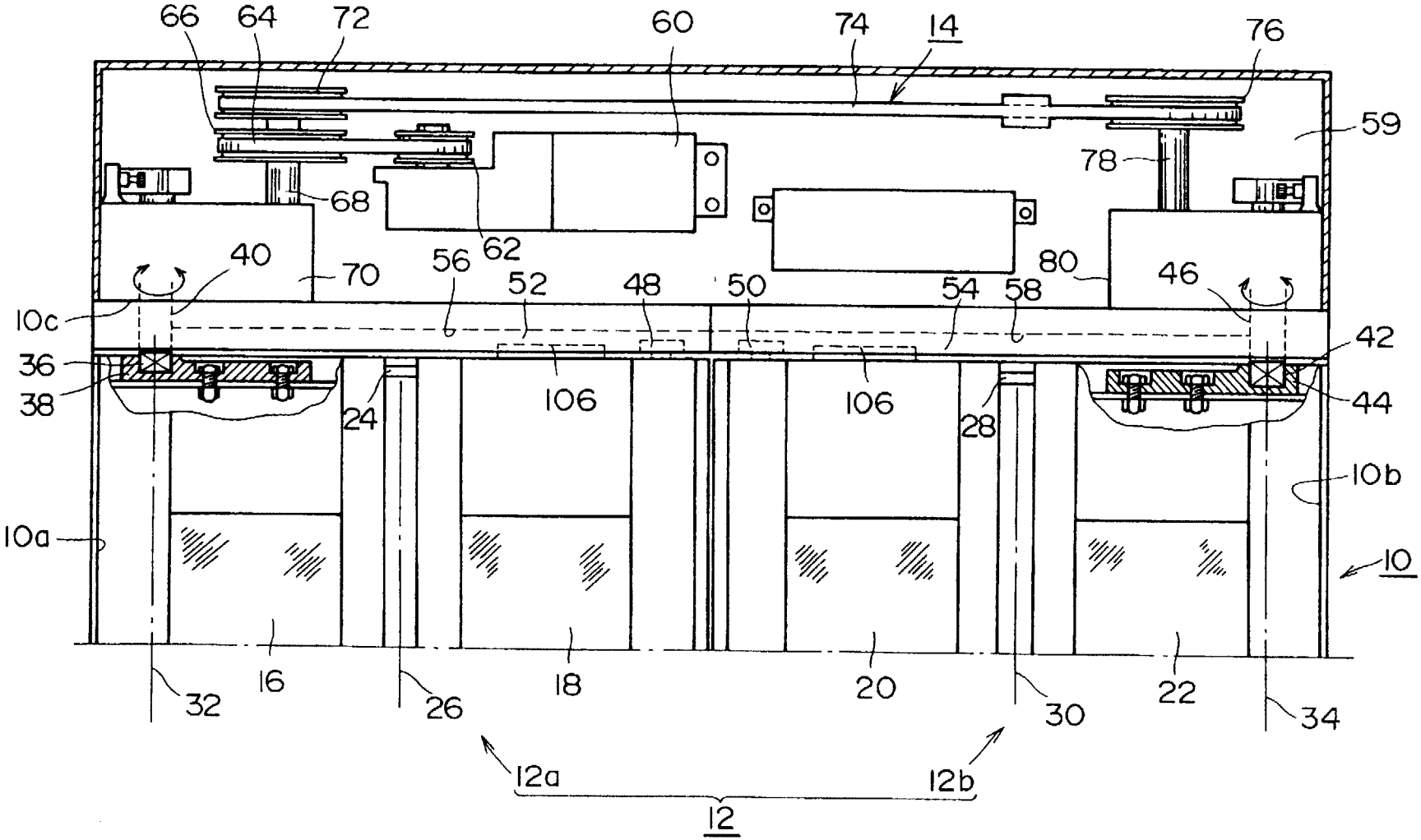
FIG. 1 is a partially broken, front elevational view of a door system according to a first embodiment of the present invention, seen from the outside of the doorway.

A door system according to a first embodiment is a double swing folding door system. As shown in FIG. 1, a door 12 is disposed within a doorway 10. A drive system 14 operates the door 12 to open or close.

The doorway 10 is rectangular and is formed in a building, for example. It is rectangular and is defined by two parallel side surfaces 10*a* and 10*b*, such as opposing vertical surfaces of two jambs or walls, and a downward facing surface 10*c*, such as the lower surface of a lintel 59, and an upward facing surface (not shown) which are generally perpendicular to the side surfaces 10*a* and 10*b*. The upward facing surface may be the building floor.

The door 12 comprises folding door sections 12*a* and 12*b*. The folding door section 12*a* includes panels 16 and 18, which are rectangular. The panel 16 is disposed closer to the side surface 10*a* of the doorway 10, and the panel 18 is disposed adjacent to the panel 16. The panels 16 and 18 are connected together by an upper hinge 24 and a lower hinge (not shown) so that the door section 12*a* can be folded about an upright axis 26 located between the panels. The upright axis 26 is in parallel with the side surface 10*a*.

Similarly, the folding door section 12*b* includes panels 20 and 22 with the panel 22 position closer to the side surface 10*b* of the doorway 10 and with the panel 20 positioned between the panels 22 and 18. The panels 20 and 22 are also connected together by an upper hinge 28 and a lower hinge (not shown) so that the door section 12*b* can be folded about an upright axis 30 which is located between the panels 20 and 22 and is parallel to the side surface 10*b*.

The panels 16 and 22 of the door sections 12*a* and 12*b* are supported to be pivotal about pivot axes 32 and 34, respectively, which are located close to and in parallel with the side surfaces 10*a* and 10*b*, respectively. A panel reinforcement and driving-force transfer member 38 is secured to the upper edge of the panel 16. The panel reinforcement and driving-force transfer member 38 includes a square recess 36. The pivot axis 32 passes through the center of the square recess 36. An output shaft 40 of the drive system 14, which has a square cross-section at least in its lower end portion, is snugly fitted down into the square recess 36 so that the driving force is transferred from the drive system 14 to the panel 16 by the shaft 40. A similar panel reinforcement and driving-force transfer member 44 with a square recess 42 is secured to the upper edge of the panel 22. The pivot axis 34 passes through the center of the square recess 42. An output shaft 46 of the drive system 14 similar to the shaft 40 is snugly fitted into the recess 42 so that the driving force is transferred from the drive system 14 to the panel 22 through the shaft 46.

Although not shown, similar panel reinforcement members are secured to the corresponding locations in the lower edges of the panels 16 and 22. A round recess is formed in each of the reinforcement members in such a position that the pivot axis 32, 34 passes through the center of the recess. A shaft is fitted into the recess and supports each panel 16, 22 in a slightly lifted position so that the panel can be rotated about the pivot axis 32, 34.

Guided means, such as guide rollers 48 and 50, are secured to the upper edges of the panels 18 and 20, respectively, at the locations remote from the hinges 24 and 28, respectively. The guide rollers 48 and 50 protrude upward from the upper edges of the panels 18 and 20 and are rotatable about respective axes which are parallel with the pivot axes 32 and 34. Guide means, such as guide rails 52 and 54, are disposed along the lintel lower surface 10*c*. The guide rails 52 and 54 are provided with channels 56 and 58, respectively, which open toward the panels 16, 18, 20 and 22. The guide roller 48 is positioned within the channel 56 in such a manner that the roller 48 does not disengaged from the channel 56. Similarly, the guide roller 50 is positioned within the channel 58 in such a manner that the roller 50 does not disengaged from the channel 58. Thus, the guide rollers 48 and 50 are movable along the guide rails 52 and 54, respectively.

The drive system 14 is disposed within the lintel 59. The system 14 includes an electric motor 60 of which the rotation is transmitted via a pulley 62, a belt 64, a pulley 66 and to a shaft 68. The rotation of the shaft 68 is inputted to a speed reducer 70. The rotation of the shaft 68 is also transmitted via a pulley 72, a belt 76, and a shaft 78 to a speed reducer 80. The output shafts 40 and 46 are connected respectively to the speed reducers 70 and 80 for rotation in opposite directions so that the panels 16 and 22 are rotated in opposite directions about the pivot axes 32 and 34, respectively.

Figure 2:
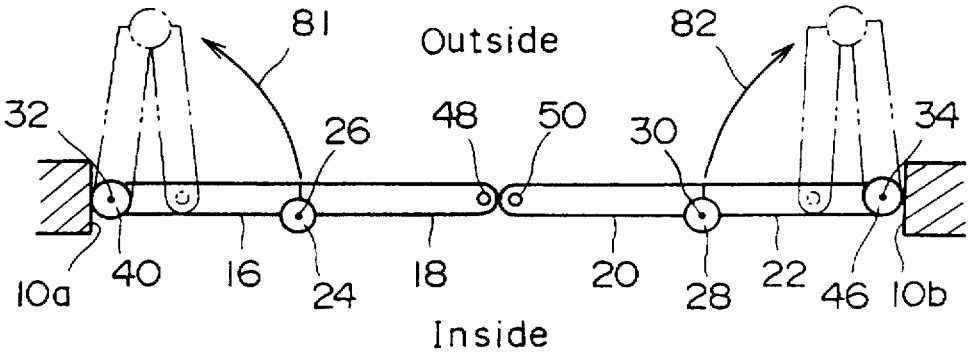
FIG. 2 is a top plan view of the door system of FIG. 1, in which the open and closed positions of the door are shown and in which arrows represent paths along which door panels move between the closed and open positions.

Rotation of the shaft 40 in one direction and rotation of the shaft 46 in opposite direction cause the hinges 24 and 28 with the pivot axes 26 and 30, respectively, in the closed position indicated by solid lines in FIG. 2, to rotate outward of the building about the pivot axes 32 and 34, as indicated by arrows 81 and 82, respectively. Since the guide rollers 48 and 50 are restricted in movement by the guide rails 52 and 54, the rotation of the hinges 24 and 28 about the pivot axes 32 and 34 causes the panels 16, 18, 20, and 22 to be folded as indicated by phantom lines in FIG. 2. Thus, the door 12 is open, with the panels 16 and 18 being back-to-back and with the panels 20 and 22 being back-to-back. Thereafter, when the output shafts 40 and 46 rotate in the directions opposite to the ones mentioned above, the panels 16 and 22 rotate in the opposite directions to the previous directions about the pivot axes 32 and 34, respectively, and, as a result, the hinges 24 and 28 rotate in the directions opposite to the directions indicated by the arrows 81 and 82. This causes the folded panels 16, 18, 20, and 22 to be unfolded to the closed position indicated by the solid lines. Thus, the rotation of the motor 60 in one direction causes the folding door sections 12*a* and 12*b* to be folded (i.e. opened), and the rotation of the motor 60 in the opposite direction causes the folding door sections 12*a* and 12*b* to be unfolded (i.e. closed).

A sensor, not shown, senses a person who approaches the double swing folding door 12, which causes the motor 60 to be automatically driven to rotate in the one direction so as to fold the door sections 12*a* and 12*b*. When the person goes out of the sensing area of the sensor, the motor 60 is automatically actuated to rotate in the opposite direction. Such an automatic door opening and closing control system is known.

The door system is provided with an emergency escape enabling mechanism according to the present invention. The emergency escape enabling mechanism is an arrangement which enables a person within the building to open the door 12 manually by pushing outward the inside surfaces of the door sections 12*a* and 12*b* in such a condition as power failure or door system failure in which the door 12 cannot automatically be opened.

The guide rails 52 and 54 are pivotal about the pivot axes 32 and 34, respectively. An engagement arrangement 82 engages each of the guide rails 52 and 54 with the lintel 59 in such a manner that each guide rail can be disengaged from the lintel 59 as occasion demands.

Figure 3:
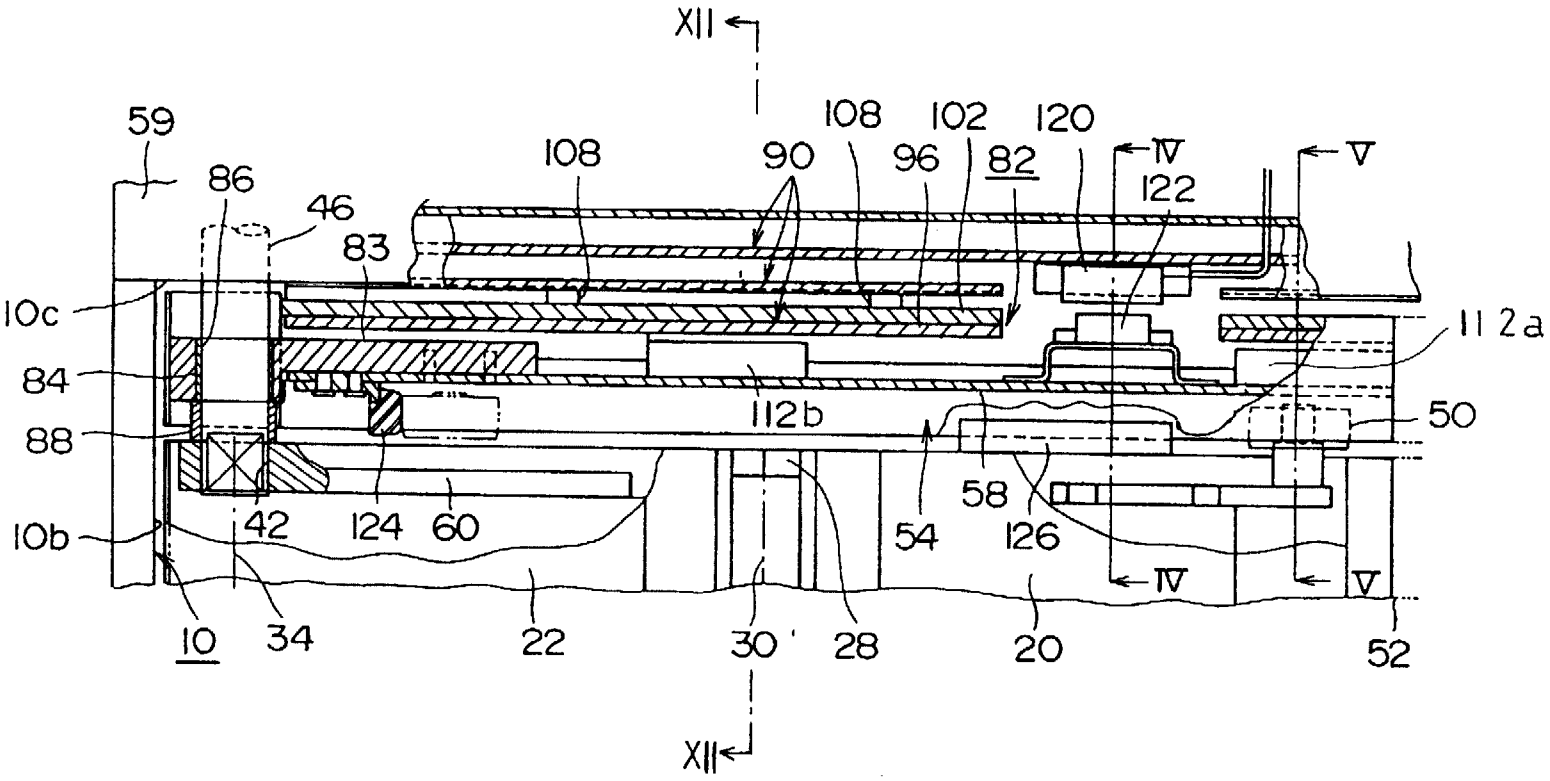
FIG. 3 is a partially broken, enlarged rear elevational view of part of the door system of FIG. 1, seen from the inside of the doorway.

As shown in FIG. 3, a guide rail reinforcement member 83 is secured to the upper surface of the guide rail 54 at its one end closer to the jamb surface 10*b*. The guide rail reinforcement member 83 includes a portion extending toward the output shaft 46, in which portion a round hole 84 coaxial with the pivot axis 34 is formed. A sleeve 86 is disposed within the hole 84, and the output shaft 46 extends through the sleeve 86 and engages with the square recess 42 in the panel reinforcement and driving-force transfer member 44. A spacer 88 is fitted over the output shaft 46 and disposed between the panel 22 and the guide rail reinforcement member 83. The described arrangement enables the guide rail 54 to be rotatable about the pivot axis 34. Although not shown, a similar arrangement is provided for the other guide rail 52 to enable the guide rail 52 to be pivotal about the pivot axis 32.

As shown in FIGS. 3, 4, 5, 6, and 7, the engagement arrangement 82 for the guide rail 54 includes a support member 90 which is mounted integral with the lower surface 10*c* of the lintel 59. As is seen from FIG. 6, the support member 90 is disposed within a recess 92 in the lintel 59. The recess 92 extends in the length direction of the lintel 59 midway between the inside and outside surfaces thereof.

The support member 90 has a wall member 94 extending downward within the recess 92. Supporting means, for example, a supporting section 96 extends generally horizontally toward the outside of the building or door from the wall member 94 at a location lower than the lintel lower surface 10*c*. The supporting section 96 is an elongated member which extends along the length of the lintel 59 and has a uniform cross-section along its length. The supporting section 96 has a slightly concave or V-shaped upper surface 98. The upper surface 100 of the tip end portion of the supporting section 96 is provided with a slightly downward slope.

The engagement arrangement 82 further includes engagement means, e.g. an engaging section 102. The engaging section 102 extends generally horizontally toward the inside of the building or door over a predetermined length, from a wall member 103 which extend upward from the guide rail 54 on the side facing the outside of the building or door. The engaging section 102 also extends along the length of the guide rail 54 and has a uniform cross-section along its length. The lower surface 104 of the engaging section 102 is shaped complementary to the shape of the upper surface 98 of the supporting section 96, i.e. shaped to slightly convex upward.

Figure 5:
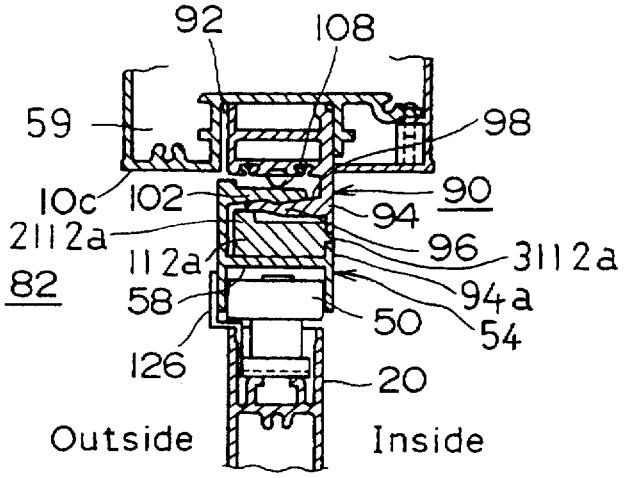
FIG. 5 is a cross-sectional view along a line V—V in FIG. 3.

In the normal condition, the engaging section 102 engages with the supporting section 96 and is supported so that the guide rail 54 is held in a predetermined position, as shown in FIG. 5. A retainer plate 106 is secured to the wall member 94 at such a level that the retainer plate 106 is substantially flush with the lower surface 10*c* of the lintel 59. As shown in FIG. 3, elastic means, such as a plurality of springs 108, are attached to the retainer plate 106 at locations spaced along the length of the plate 106. The springs 108 press the engaging section 102 downward against the supporting section 96. The springs 108 are movable within and along the grooves 110 formed in the retainer plate 106 along its length and fixed at desired locations by the aid of their spring force. Because of the spring force of the springs 108 pressing the engaging section 102 against the supporting section 96, an ordinary force exerted to the inside surface of the panel 20 or 22 in the direction normal to their plane cannot cause disengagement of the engaging section 102 from the supporting section 96.

An engagement arrangement similar to the engagement arrangement 82 is provided for the guide rail 52, but its details are not described.

As shown in FIGS. 3–7 and 12, first and second stopper members 112*a* and 112*b* are secured to the upper surface of the guide rail 54 at spaced locations. The first stopper member 112*a* is located remote from the pivot axis 34 and, hence, from the output shaft 46, and the second stopper member 112*b* is located closer to the pivot axis 34 and, hence, to the output shaft 46. The first and second stopper members 112*a* and 112*b* are spaced by a small distance from each of the outer and inner portions 116 and 114 of the lower surface of the supporting section 96.

The first and second stopper members 112*a* and 112*b* are disposed for the following purpose. The supporting section 96 and the engaging section 102 are located above the guide rail 54, and therefore, the difference in level between the location where the guide roller 50 contacts the guide rail 54 and the location where the supporting section 96 supports the engaging section 102 is large. During normal door opening and closing operation, a force exerted to the door in a direction perpendiculr to the door surface produces a relatively large bending moment about the location where the supporting section 96 and the engaging section 102 contact each other, which could cause the door to swing during its normal operation. The stopper members 112*a* and 112*b* prevent this swinging of the door, so that unintentional disengagement of the engaging section 102 from the supporting section 96 is avoided.

Figure 12:
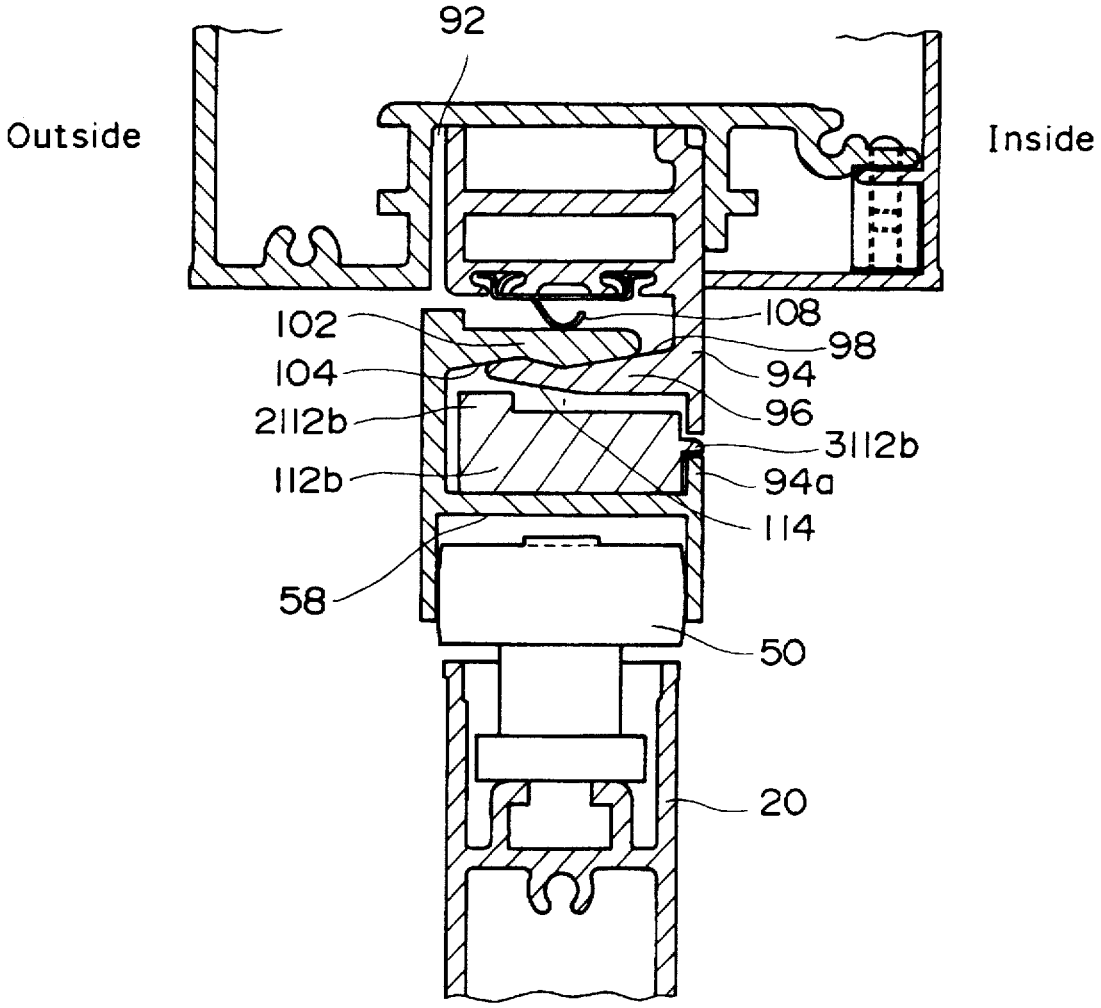
FIG. 12 is a cross-sectional view along a line XII—XII in FIG. 3.

As is shown in FIGS. 5 and 12, each of the first and second stopper members 112*a* and 112*b* may be a block of material. The stopper member 112*a*, 112*b* includes an upward projecting land 2112*a*, 2112*b* at a location on its outer side.

As shown in FIG. 5, when the supporting section 96 and the engaging section 102 are in engagement with each other, the land 2112*a* is in contact with the tip end portion of the supporting section 96, while, as shown in FIG. 12, the land 2112*b* is spaced by a small distance from the tip end of the supporting section 96.

Each of the first and second stopper members 112*a* and 112*b* has a projection 3112*a*, 3112*b* which extends inward at a location intermediate between the upper and lower edges of the inside surface of the stopper member. As shown in FIG. 5, the projection 3112*a* is in contact with the lower edge of the wall member 94. The projection 3112*a* is also in contact with the upper edge of a wall member 94*a* which extends upward from the upper surface of the guide rail 54 on its inner side. The projection 3112*b* is located between and spaced by a small distance from the lower edge of the wall member 94 and the upper edge of the wall member 94*a*, as shown in FIG. 12.

Let it be assumed that the panel 20 receives a force which tends to cause the panel 20 to swing about an axis extending along the length of the guide rail 54 in the counterclockwise direction in the plane of the sheet of FIG. 5 or 12. The land 2112*a* and the projection 3112*a* of the first stopper member 112*a* have been already in contact with the supporting member 96 and the wall member 94, respectively, and the land 2112*b* and the projection 3112*b* of the second stopper member 112*b* are brought into contact with the supporting section 96 and the lower edge of the wall member 94. On the other hand, if a force tending to swing the panel 20 in the clockwise direction is exerted to the panel 20, the projection 3112*b* of the second stopper member 112*b* is brought into contact with the upper edge of the wall member 94*a*, with the projection 3112*a* of the first stopper member 112*a* having been already in contact with the upper edge of the wall member 94*a*. Thus, the panel 20 cannot swing much in either direction.

The guide rail 54 has a relatively large length and can be formed of, for example, aluminum. One end of the guide rail 54 is coupled to the output shaft 46. Accordingly, the rigidity exhibited by the guide rail 54 is higher in a portion closer to the output shaft 46 and becomes lower in a portion farther from the output shaft 46.

As will be described later, if the engaging section 102 is disengaged from the supporting section 96, it must be brought back into engagement with the supporting section 96. Let it be assumed that the land 2112*b* and the projection 3112*b* of the second stopper member 112*b*, which is located closer to the output shaft 46, were to contact with the lower surface of the supporting section 96 and the edges of the wall members 94 and 94*a*, respectively, when the engaging section 102 and the supporting section 96 are in engagement with each other. Then, when the engaging section 102 is moved to ride on the upper surface of the supporting section 96, the land 2112*b* would first contact the lower surface of the supporting section 96, which would make it difficult to make the engaging section 102 to ride on the upper surface of the supporting section 96 and to insert the projection 3112*b* between the wall members 94 and 94*a*, because the guide rail 54 exhibits higher rigidity in the portion closer to the output shaft 46.

In order to make the engaging section 102 easily ride on the supporting section 96, it is arranged such that a space is disposed between the land 2112*b* of the second stopper member 112*b* and the lower surface of the supporting section 96 and also a space is disposed between the projection 3112*b* and each of the wall members 94 and 94*a* when the engaging section 102 is resting on the supporting section 96.

As for the first stopper member 112*a*, because of lower rigidity exhibited by the guide rail 94 at the portion where the first stopper member 112*a* is secured, the engaging section 102 can easily ride on the supporting section 96 and the projection 3112*b* can easily enter into the space between and contact the wall members 94 and 94*a* even if the land 3112*a* comes into contact with the lower surface of the supporting section 96 and the projection 3112*a* comes into contact with one of the walls 94 and 94*a* during movement of the engaging section 96 onto the supporting section 96.

Figure 4:
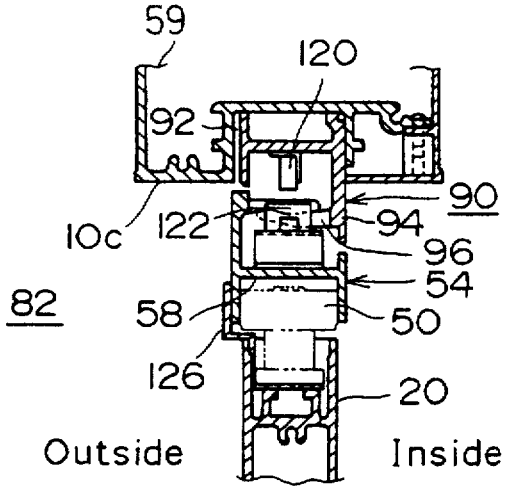
FIG. 4 is a cross-sectional view along a line IV—IV in FIG. 3.

As shown in FIGS. 3 and 4, a lead switch 120 and a magnet 122 can be mounted in a space between the first and second stopper members 112*a* and 112*b* which are mounted being spaced from each other. The lead switch 120 and the magnet 122 are used to detect whether the guide rail 54 is in a predetermined position where the engaging section 102 is resting on the supporting section 96.

Further, as shown in FIG. 3, a rubber stopper 124 for the guide roller 50 is disposed within the channel 58 of the guide rail 54 to limit the movement of the guide roller 50 when the door 12 is automatically opened by the actuation of the drive system 14. Another stopper 126 for the panel 20 is secured to the panel 20 which abuts against the outside surface of the guide rail 54 to prevents the panel 20 from moving inward. More specifically, the stopper 126 prevents the folding door section 12*b* from being folded inward when the portion of the panel 20 closer to the panel 18 is pushed outward. Members similar to the stopper member 112, the lead switch 120 and the magnet 122, and the stoppers 124 and 126 are provided for the other folding door section 12*a*, too.

Figure 8:
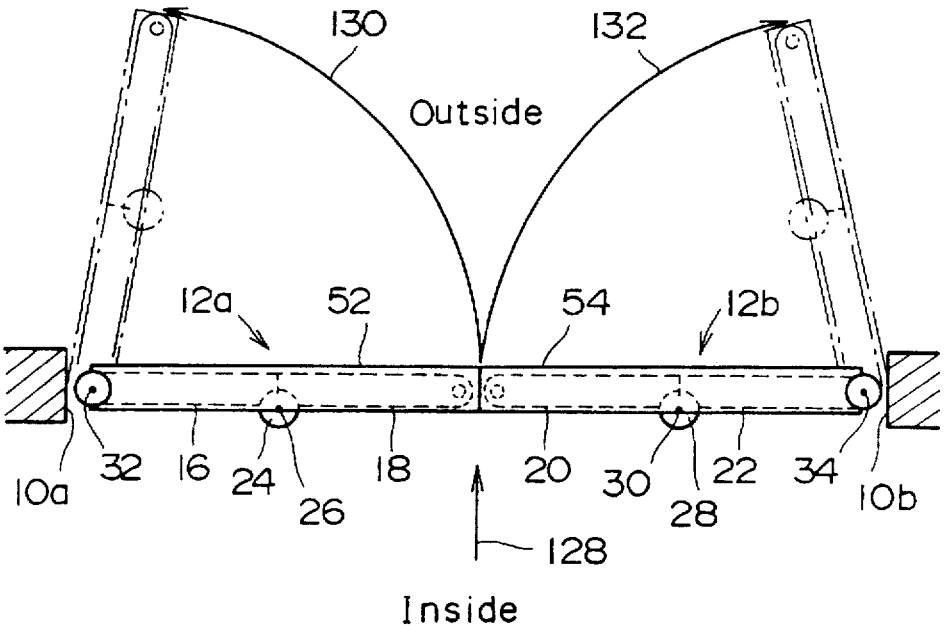
FIG. 8 is a top plan view of the door system of FIG. 1, in which arrows represent the paths along which door panels and guide rails move when the emergency escape enabling mechanism is operated.

When one wants to escape from the building under an emergency condition, he or she pushes with a strong force the inside surfaces of the folding door sections 12*a* and 12*b* in the closed position indicated by solid lines in FIG. 8, in the outward direction generally normal to the inside surfaces as indicated by an arrow 128. This causes the engaging section 102 to be disengaged from the supporting section 96, and the panels 16 and 18 held in the same plane and the panels 20 and 22 held in the same plane are rotated together with the associated guide rails 52 and 54 about the associated pivot axes 32 and 34 as indicated by arrows 130 and 132, respectively, to the open position indicated by dash-and-dot lines.

The process of disengagement of the engagement arrangement 82 is shown in succession in FIGS. 3 through 7. FIGS. 3 through 4 show the state in which the engaging section 102 is in engagement with the supporting section 96. The engaging section 102 is disengaged from the supporting section 96 successively from the position shown in FIGS. 3–5 through the position shown in FIG. 6 to the position shown in FIG. 7. When the engaging section 102 is in engagement with the supporting section 96, the upper surface 98 of the supporting section 96 is snugly fit with the lower surface 104 of the engaging section 102, with the springs 108 pressing the engaging section 102 downward against the supporting section 96. Therefore, the engaging section 102 is never disengaged from the supporting section 96 in the normal operation of the door system.

Figure 6:
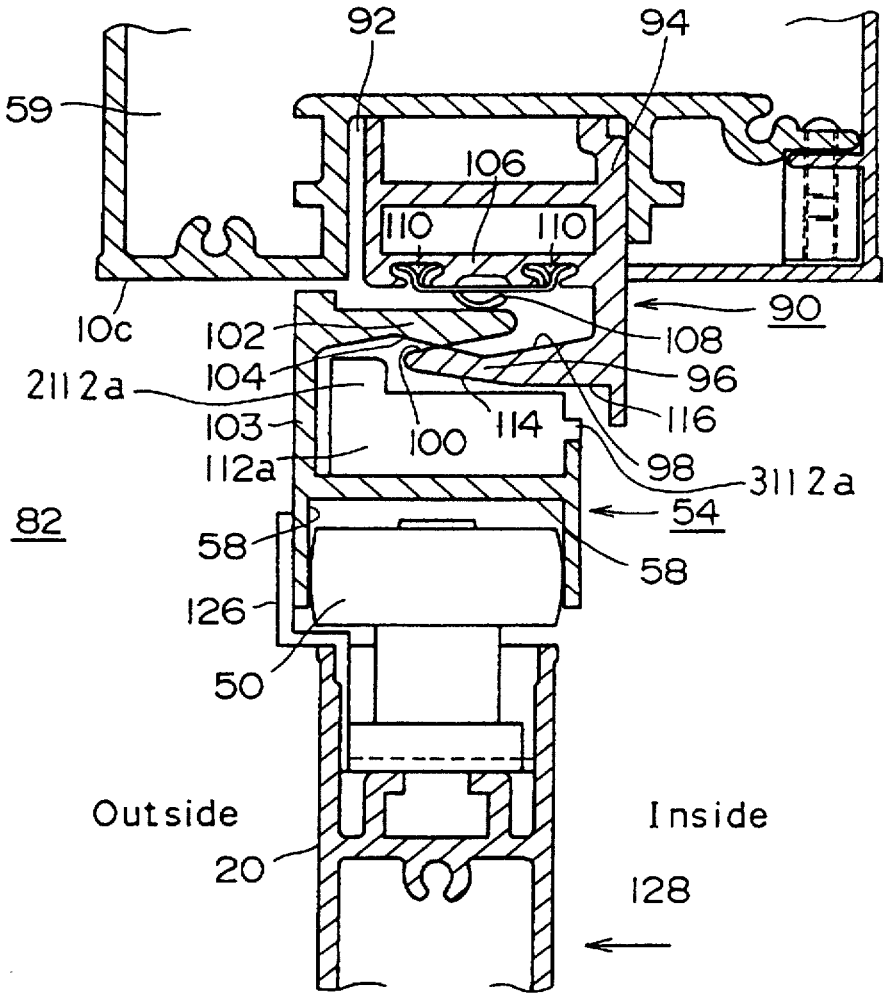
FIG. 6 is a cross-sectional view corresponding to FIG. 5, showing how engaging means of the first embodiment disengages from support means.
Figure 7:
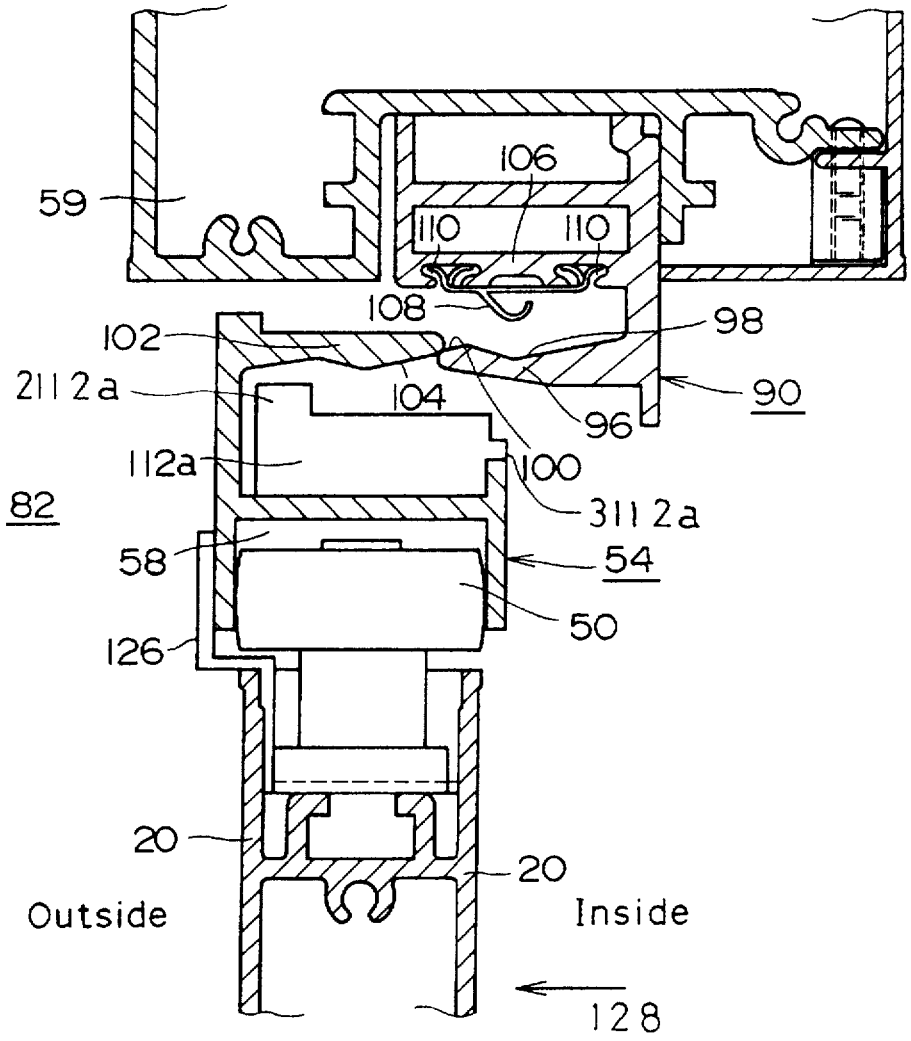
FIG. 7 is a cross-sectional view corresponding to FIG. 5, showing further disengagement of the engaging means and the support means of the first embodiment.

However, if a person pushes strongly the folding door sections 12*a* and 12*b* outward from the inside the door 12 in the direction generally normal to the plane of the door sections 12*a* and 12*b*, the engaging section 102 is slightly lifted, moving along the upper surface 98 of the supporting section 96, and deforming the springs 108, as shown in FIG. 6. The engaging section 102 is then lowered along the sloped portion 100 of the upper surface 98 of the supporting section 96, and disengaged as shown in FIG. 7. The disengagement of the engaging section 102 from the supporting section 96 occurs at locations along the length of the guide rails 52 and 54 at successively different times, in such a manner as two blades of scissors successively depart from each other. When the disengagement along the entire length of the guide rails 52 and 54 has been completed, the positions of the folding door sections 12*a* and 12*b* are slightly lower than their positions when the section 102 is in engagement with the supporting section 96.

The force counteracting the force to disengage the engaging section 102 from the supporting section 96 depends partly on the spring force given by the spring 108. Therefore, by adjusting the position of the springs 108, the force required for the emergency door opening operation can be adjusted. As the springs 108 are moved closer to the pivot axis 34, the smaller force is required for disengaging the engagement arrangement.

After the emergency door swinging-open operation, if the folding door sections 12*a* and 12*b* are not damaged, they can be returned or reset to its original position for the normal use. The resetting of the door 12 is effectuated by pushing swinging back the folding door sections 12*a* and 12*b* along the paths indicated by the arrows 130 and 132 in FIG. 8 but in the opposite directions. That is, the process of resetting the door 12 is quite opposite to the process of manually swinging open the door under emergency conditions and is similar to the process of closing blades of scissors in which the blades approach each other successively from their proximal ends to the distal ends. The engaging sections 102 easily override the associated supporting sections 96 with the overriding action moving successively from portions closer to the pivot axes 32 and 34 toward portions closer to the panels 18 and 20, respectively. The slope formed in the distal end 100 of each supporting section 96 facilitates the overriding action of the engaging section 102.

As described above, the door 12 can be easily set in place within the doorway 10 by simply swinging the folding door sections 12*a* and 12*b* back to their original positions. Thus, it is easy even for people who are not familiar with the structure of the emergency escape enabling mechanism of the door system, to set the door 12 in place.

Figure 9:
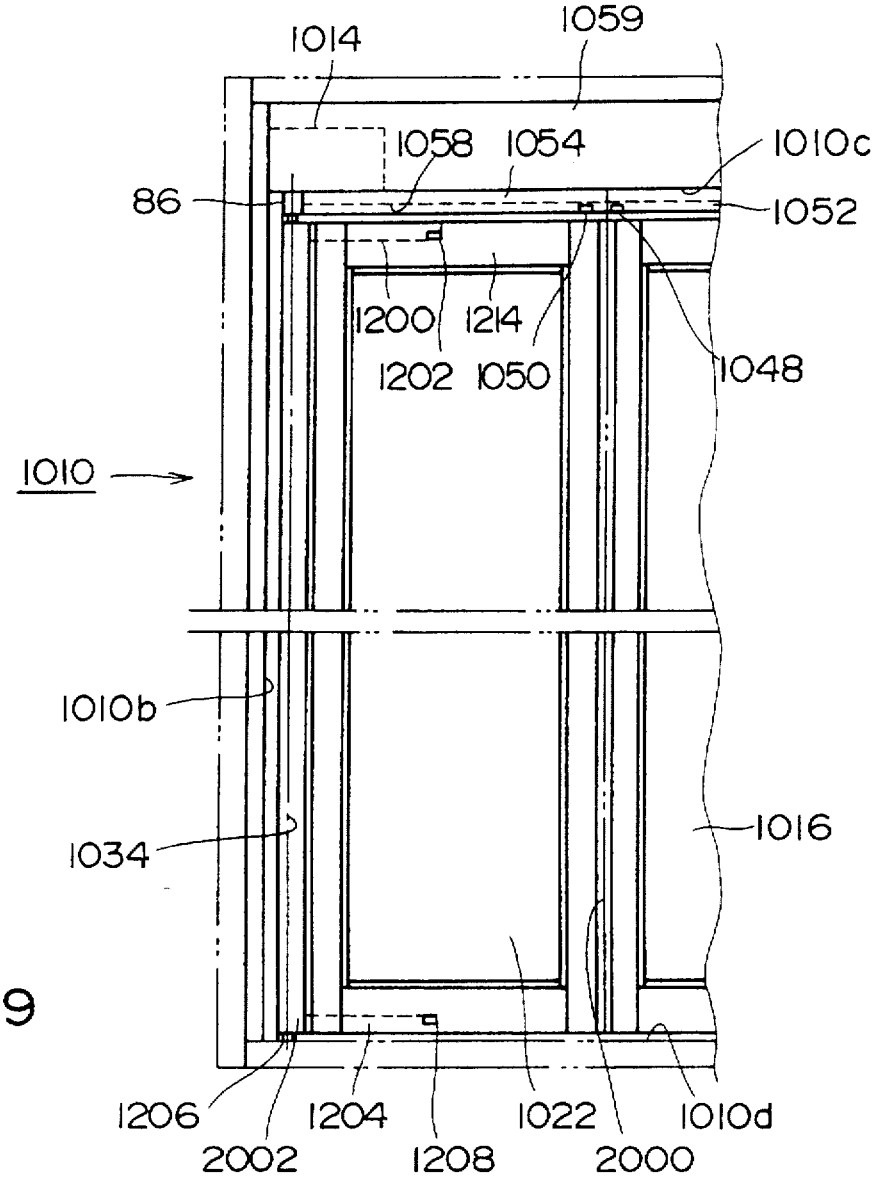
FIG. 9 is a front view of part of a door system according to a second embodiment of the present invention, seen from the outside.
Figure 10:
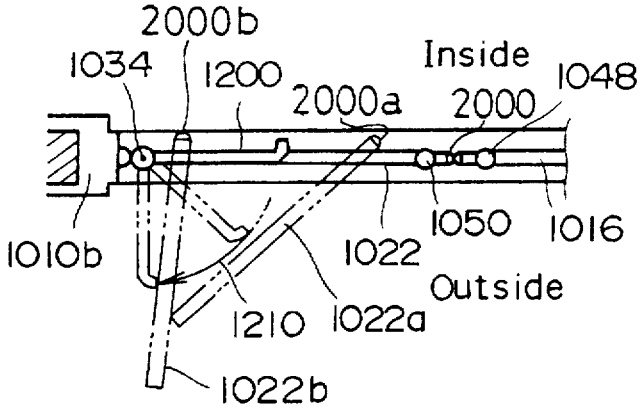
FIG. 10 is a top plan view of the door system of FIG. 9, in which the open and closed positions of the door are shown and in which arrows indicate paths along which door panels move between the closed and open positions.
Figure 11:
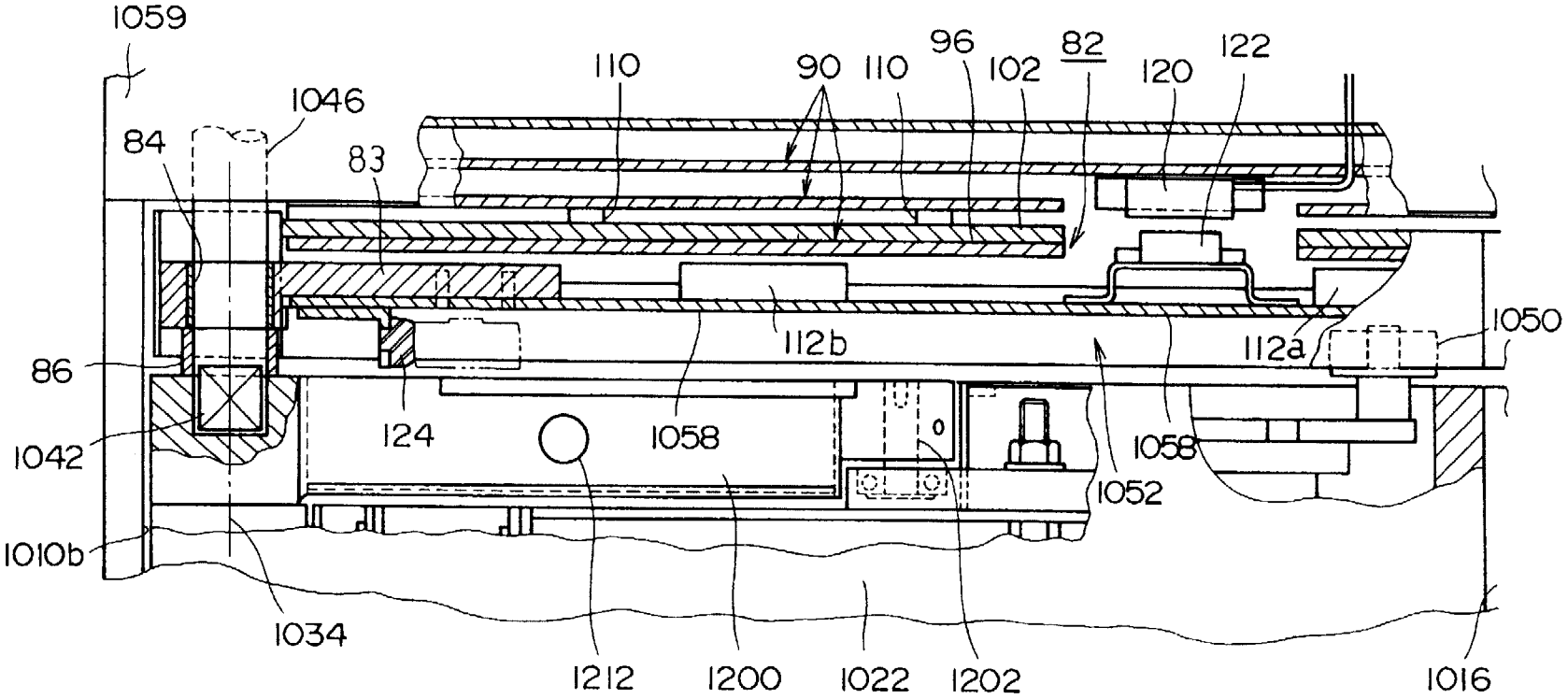
FIG. 11 is a partially broken, enlarged front elevational view of part of the door system of FIG. 9.

A door system according to a second embodiment of the present invention is shown in FIGS. 9, 10, and 11. The door system of the second embodiment is a double-swing balanced door provided with an emergency escape enabling mechanism which is similar to the one used in the first embodiment.

A double-swing balanced door 1010 is disposed within a doorway. The doorway is rectangular and is defined by mutually parallel, opposing upper and lower horizontal surfaces 1010*c* and 1010*d*, and mutually parallel, opposing vertical surfaces 1010*a* and 1010*b*. In FIG. 9, only one, 1010*b*, of the vertical surfaces is shown. The upper horizontal surface 1010*c* may be the lower surface of a lintel 1059, the lower horizontal surface 1010*d* may be the upper surface of a base frame member, and the vertical surfaces 1010*a* and 1010*b* may be side surfaces of jambs.

The door 1010 includes panels 1016 and 1022 disposed adjacent to each other within the doorway. The panel 1022 has a vertical side edge 2000 which is located adjacent to the panel 1016 when the panels 1016 and 1022 are in the closed position. The panel 1022 has another vertical side edge 2002 which is located adjacent to the doorway vertical surface 1010*b* when the panels are in the closed position.

An upper arm 1200 extends from a location close to the surface 1010*b* toward the other surface 1010*a* along the upper edge of the panel 1022. The upper arm 1200 is provided with a square recess 1042 in the portion close to the side surface 1010*b*, as shown in FIG. 11. A pivot axis 1034 passes through the center of the recess 1042. The lower end of an output shaft 1046 of a drive system 1014 snugly fits in the square recess 1042. As shown in FIG. 9, the drive system 1014 is disposed within a space provided in the lintel 1059. The distal end of the upper arm 1200 is located approximately at the midpoint between the pivot axis 1034 and a guide roller 1050, which will be further mentioned later, disposed to rotate about a shaft secured to the upper edge of the panel 1022 at a location adjacent to the side edge 2000. The distal end of the upper arm 1200 is coupled to the panel 1022 by a shaft 1202.

A lower arm 1204 extends from a location close to the side surface 1010*b* along the lower edge of the panel 1022. The lower arm 1204 is connected to the upward facing surface 1010*d* of the doorway by a shaft 1206 having a longitudinal center axis coaxial with the pivot axis 1034 so as to be pivotal about the shaft 1206. The distal end of the lower arm 1204 is located approximately at the midpoint between the vertical sides 2000 and 2002 of the panel 1022, and is connected to the panel 1022 by a shaft 1208.

A guide rail 1054 is disposed to extend along the lintel lower surface 1010*c*. The guide rail 1054 includes a channel 1058 opening toward the panel 1022. The afore-mentioned guide roller 1050 is disposed within the channel 1058. The shaft about which the guide roller 1050 is pivotal is in parallel with the pivot axis 1034 and has its lower end secured to the upper edge of the panel 1022.

A similar structure is provided for the panel 1016, including a drive system, an upper arm, and a lower arm, which are not shown, and a guide roller 1048 and a guide rail 1052 as shown.

Normally, the balanced door 1010 is opened and closed by the actuation of the drive system 1014. When the door is closed so that the panels 1016 and 1022 are in the position indicated by solid lines in FIG. 10, the drive system 1014 drives a shaft 1046 (FIG. 11) to rotate in one direction to thereby cause the arms 1200 and 1204 to pivot about the pivot axis 1034 in the direction indicated by an arrow 1210 in FIG. 10. When the drive system 1014 drives the shaft 1046 in the opposite direction, the door 1010 assumes its closed position.

More specifically, since the panel 1022 is restricted in movement by the guide rail 1054 and the guide roller 1050 when the arms 1200 and 1204 rotate about the pivot axis 1034, the side edge 2000 of the panel 1022 moves toward the side surface 1010*b* along the guide rail 1054, while the side edge 2002 moves outward generally in the direction parallel to the side surface 1010*b*. As a result, the panel 1022 assumes the position indicated by phantom lines 1022*a*, and, then, moves to the position indicated by phantom lines 1022*b* in FIG. 10. The panel 1016 moves between its closed and open positions as the panel 1022 moves between its closed and open positions.

Since the distal end of the arm 1200 is coupled to the panel 1022 approximately at the midpoint between the pivot axis 1034 and the guide roller 1050, the side edge 2000 of the panel 1022 does not protrude inward of the doorway when it is moving from the closed position to the open position or when it is in the open position, as indicated by reference numerals 2000*a* and 2000*b* in FIG. 10. Accordingly, when a person goes out of the building through the doorway, the side edge 2000 does not come toward the person standing inward of the doorway, and, therefore, does not obstruct the passage. Further, since the side edge 2000 does not protrude inward, the area immediately inward of the doorway can be used as part of a path extending in parallel with the doorway, which allows frequent passage of people therethrough. Although not shown, the panel 1016 moves in the same manner as the panel 1022.

An emergency escape enabling mechanism provided for this door system is of the same structure as the one provided for the door system of the first embodiment described with reference to FIGS. 1–8. The same reference numerals as used in FIGS. 1–8 are attached to similar components shown in FIGS. 9–11, and the details are not described further.

When a person pushes strongly the panel 1022 and/or panel 1016 from the inside toward the outside of the doorway, the engaging section 102 of the engagement arrangement is disengaged from the supporting section 96 so that the door 1010 can be swung open outward. The resetting operation of the opened door panels is also the same as that of the first embodiment.

As shown in FIG. 11, a stop 1212 is attached to the outside surface of the upper arm 1200. The stop 1212 is in contact with the outside surface 1214 (FIG. 9) of the upper edge portion of the panel 1022 to prevent the pivotal motion of the panel 1022 about the shaft 1202 in the opposite direction when the panel 1022 is pushed outward.

In the described second embodiment, the guide roller 1050 is disposed to locate at a position near the panel 1016, but it may be disposed at the mid-point or near the mid-point along the upper edge of the panel 1022, as is done in the previously referenced Catlett's U.S. Pat. No. 3,675,370. In case that the guide roller is disposed in such a location, the arm 1200 should be connected to the panel at substantially the midpoint between the guide roller 1050 and the pivot axis 1034.

In the above-described embodiments, the doors are described to be double-swing doors, but the present invention can be embodied in single-swing doors, too.

What is claimed is:

1. A door system comprising:

a doorway defined by opposing, parallel, vertical surfaces provided by mutually parallel, vertical jamb means and a horizontal surface provided by lintel means;

a door selectively opening and closing said doorway, said door including a panel which is pivotal about a pivot axis established close to and parallel to one of said vertical surfaces, said panel including guided means extending from an upper edge of said panel toward said lintel means at a location remote from the location of said pivot axis when the door is closed;

guide means mounted to be pivotal about said pivot axis and disposed to extend along said horizontal surface of said lintel means, said guide means guiding said guided means along said horizontal surface of said lintel means; and an engagement arrangement for disengageably engaging said guide means with said lintel means;

wherein said engagement arrangement comprises:

a first wall formed on said lintel means to extend along the length of said lintel means and also extend downward of said horizontal surface of said lintel means to a position spaced from an upper surface of said guide means;

support means extending horizontally away in a first direction from a lower portion of said first wall, said support means having a uniform transverse cross-section along the length thereof;

a second wall formed on said guide means to extend along the length of said guide means and also extend upward from said upper surface of said guide means;

engagement means extending horizontally away in a second direction opposite to said first direction from an upper portion of said second wall and having a uniform transverse cross-section along the length thereof, said engagement means being adapted to ride on said support means to engage therewith; and stopper means disposed between a lower surface of said support means and the upper surface of said guide means for restricting the swinging of said guide means.

2. The door system according to claim 1 wherein a plurality of said stopper means are disposed, being spaced along the length of said guide means.

3. The door system according to claim 2 wherein:

said support means has an upward facing concave first surface on which said engagement means is adapted to ride;

said engagement means has a downward facing convex second surface which is adapted to engage with said first surface;

said guide means has a third wall extending upward from the upper surface thereof; and each of said stopper means has a land which can contact with said lower surface of said support means at a location remote from said first wall, and a projection which can contact with a lower edge of said first wall and an upper edge of said third wall.

4. The door system according to claim 3 wherein:

first one of said plurality of said stopper means is disposed at a location remote from said pivot axis, and second one of said plurality of said stopper means is disposed at a location closer to said pivot axis;

said first one of said plurality of said stopper means includes a first land contacting said lower surface of said support means at a location remote from said first wall, and a first projection contacting the lower edge of said first wall and the upper edge of said third wall; and said second one of said plurality of said stopper member includes a second land normally spaced from the lower surface of said support means at a location remote from said first wall, and a second projection normally spaced from the lower edge of said first wall and the upper edge of said third wall.

5. A door system comprising:

a doorway defined by opposing, parallel, vertical surfaces provided by mutually parallel, vertical jamb means and a horizontal surface provided by lintel means;

a door selectively opening and closing said doorway, said door having a pivot axis established close to and parallel to one of said vertical surfaces, and including a panel coupled to an arm extending from said pivot axis, said panel including guided means extending from an upper edge of said panel toward said lintel means at a location remote from the location of said pivot axis when the door is closed;

guide means mounted to be pivotal about said pivot axis and disposed to extend along said horizontal surface of said lintel means, said guide means guiding said guided means along said horizontal surface of said lintel means; and an engagement arrangement for disengageably engaging said guide means with said lintel means;

wherein said engagement arrangement comprises:

a first wall formed on said lintel means to extend along the length of said lintel means and also extend downward of said horizontal surface of said lintel means to a position spaced from an upper surface of said guide means;

support means extending horizontally away in a first direction from a lower portion of said first wall, said support means having a uniform transverse cross-section along the length thereof;

a second wall formed on said guide means to extend along the length of said guide means and also extend upward from said upper surface of said guide means;

engagement means extending horizontally away in a second direction opposite to said first direction from an upper portion of said second wall and having a uniform transverse cross-section along the length thereof, said engagement means being adapted to ride on said support means to engage therewith; and stopper means disposed between a lower surface of said support means and the upper surface of said guide means for restricting the swinging of said guide means.

6. The door system according to claim 5 wherein said arm is coupled to said panel at a location approximately midway between said pivot axis and said guided means.

7. The door system according to claim 5 wherein a plurality of said stopper means are disposed, being spaced along the length of said guide means.

8. The door system according to claim 7 wherein:

said support means has an upward facing concave first surface on which said engagement means is adapted to ride;

said engagement means has a downward facing convex second surface which is adapted to engage with said first surface;

said guide means has a third wall extending upward from the upper surface thereof; and each of said stopper means has a land which can contact with said lower surface of said support means at a location remote from said first wall, and a projection which contact with a lower edge of said first wall and an upper edge of said third wall.

9. The door system according to claim 8 wherein:

first one of said plurality of said stopper means is disposed at a location remote from said pivot axis, and second one of said plurality of said stopper means is disposed at a location closer to said pivot axis;

said first one of said plurality of said stopper means includes a first land contacting said lower surface of said support means at a location remote from said first wall, and a first projection contacting the lower edge of said first wall and the upper edge of said third wall; and said second one of said plurality of said stopper means includes a second land normally spaced from the lower surface of said support means at a location remote from said first wall, and a second projection normally spaced from the lower edge of said first wall and the upper edge of said third wall.

* * * * *